US009595229B2

(12) United States Patent
Cho et al.

(10) Patent No.: US 9,595,229 B2
(45) Date of Patent: Mar. 14, 2017

(54) LOCAL DIMMING METHOD AND LIQUID CRYSTAL DISPLAY

(75) Inventors: Byoungchul Cho, Seoul (KR); Heejung Hong, Seoul (KR); Daeho Cho, Paju-si (KR); Changkyun Park, Inchon (KR)

(73) Assignee: LG DISPLAY CO., LTD., Seoul (KR)

( * ) Notice: Subject to any disclaimer, the term of this patent is extended or adjusted under 35 U.S.C. 154(b) by 244 days.

(21) Appl. No.: 13/304,011

(22) Filed: Nov. 23, 2011

(65) Prior Publication Data

US 2012/0133685 A1 May 31, 2012

(30) Foreign Application Priority Data

Nov. 25, 2010 (KR) ..... 10-2010-0118265

(51) Int. Cl.
*G09G 3/36* (2006.01)
*G09G 3/34* (2006.01)

(52) U.S. Cl.
CPC ... *G09G 3/3426* (2013.01); *G09G 2320/0646* (2013.01)

(58) Field of Classification Search
CPC ..... G09G 3/3044–3/2055; G09G 2320/045; G09G 2320/062–2320/0653; G09G 3/3406–3/342; G09G 2320/0233–2320/0285; G09G 2310/0237; G06G 3/06–3/19; G06G 3/2003–3/2081; G06G 3/2044–3/2066; G06G 3/34–3/38
USPC ..... 345/87–104
See application file for complete search history.

(56) References Cited

U.S. PATENT DOCUMENTS

| | | | | |
|---|---|---|---|---|
| 2003/0201968 | A1* | 10/2003 | Itoh et al. | 345/102 |
| 2009/0109165 | A1* | 4/2009 | Park et al. | 345/102 |
| 2010/0020005 | A1* | 1/2010 | Jung et al. | 345/102 |
| 2011/0025725 | A1* | 2/2011 | Hulze | 345/690 |
| 2011/0037785 | A1* | 2/2011 | Shiomi | 345/690 |
| 2011/0292018 | A1* | 12/2011 | Kubota et al. | 345/211 |
| 2012/0139974 | A1* | 6/2012 | Sakai | G09G 3/3426 345/690 |

* cited by examiner

*Primary Examiner* — Sanghyuk Park
(74) *Attorney, Agent, or Firm* — Brinks Gilson & Lione

(57) ABSTRACT

A local dimming method and a liquid crystal display using the same are provided. The local dimming method includes segmenting an input image into N×M (where N and M are positive integer greater than n) blocks; determining representative values of the blocks, which define average luminance of the respective blocks; analyzing the input image; setting a spatial filter mask having a size of n×n (where n is a positive integer greater than 3 and equal to or smaller than 10), increasing the number of coefficients greater than 0 in the spatial filter mask when the input image is determined as a dark image, and decreasing the number of coefficients greater than 0 in the spatial filter mask when the input image is determined as a bright image; and multiplying the block representative values by coefficients of the spatial filter mask to determine a dimming value for each block.

10 Claims, 9 Drawing Sheets

250 nit 150 nit 90 nit

FIG. 5A

| | | | | |
|---|---|---|---|---|
| h1 | h2 | h3 | h4 | h5 |
| h6 | h7 | h8 | h9 | h10 |
| h11 | h12 | h13 | h14 | h15 |
| h16 | h17 | h18 | h19 | h20 |
| h21 | h22 | h23 | h24 | h25 |

FIG. 5B

| | | | | |
|---|---|---|---|---|
| 1/32 | 1/16 | 1/8 | 1/16 | 1/32 |
| 1/16 | 1/8 | 1/4 | 1/8 | 1/16 |
| 1/8 | 1/4 | 1/2 | 1/4 | 1/8 |
| 1/16 | 1/8 | 1/4 | 1/8 | 1/16 |
| 1/32 | 1/16 | 1/8 | 1/16 | 1/32 |

Image dark overall

FIG. 5C

| | | | | |
|---|---|---|---|---|
| 0 | 0 | 0 | 0 | 0 |
| 0 | 1/16 | 1/8 | 1/16 | 0 |
| 0 | 1/8 | 1/4 | 1/8 | 0 |
| 0 | 1/16 | 1/8 | 1/16 | 0 |
| 0 | 0 | 0 | 0 | 0 |

Image bright overall

LOCAL DIMMING METHOD AND LIQUID CRYSTAL DISPLAY

This application claims the benefit of Korea Patent Application No. 10-2010-0118265 filed on Nov. 25, 2010, the entire contents of which is incorporated herein by reference for all purposes as if fully set forth herein.

BACKGROUND

Field of the Invention

The present disclosure relates to a local dimming method and a liquid crystal display using the same.

Discussion of the Related Art

The application of a liquid crystal display has increased due to its characteristics of light weight, compact size, low power consumption operation, etc. A backlit liquid crystal display displays images by controlling an electric field applied to a liquid crystal layer to modulate light received from a backlight unit.

The picture quality of a liquid crystal display depends on contrast. There are limitations in improving the contrast only by modulating transmittance of a liquid crystal layer of the liquid crystal display. To solve this problem, a backlight dimming method for adjusting the brightness of a backlight depending on image has been developed so as to remarkably improve the contrast of the liquid crystal display. The backlight dimming method can reduce power consumption by adaptively adjusting the brightness of the backlight depending on input image. The backlight dimming method includes a global dimming method that adjusts the brightness of the overall display screen and a local dimming method that divides the display screen into a plurality of blocks and independently adjusts the brightness of the blocks.

The global dimming method can improve a dynamic contrast measured between a previous frame and the next frame. The local dimming method can locally adjust the brightness of the display screen within one frame period so as to improve a static contrast that is difficult to enhance by the global dimming method.

The local dimming method segments a light-emitting face of a backlight into a plurality of blocks, and increases a backlight luminance of a block corresponding to a bright image while decreasing a backlight luminance of a block corresponding to a relatively dark image. As shown in FIGS. 1A, 1B and 1C, the local dimming method can control the backlight luminance more accurately when the number of segmented blocks of the light-emitting surface of the backlight increases. On the other hand, a luminance contribution degree of one block decreases when the number of segmented blocks increases, as shown in FIGS. 1A, 1B and 1C.

A dimming value for each block in local dimming may be determined by a spatial filter. The spatial filter can improve undesired halo effect and luminance non-uniformity by diffusing a peak luminance of a backlight to surrounding blocks to reduce the spatial frequency of the backlight luminance. A conventional spatial filter has a fixed mask size and a fixed mask coefficient. Accordingly, a local dimming method using the conventional spatial filter decreases the backlight luminance when the number of segmented blocks of the light-emitting surface of the backlight increases. This darkens displayed images.

BRIEF SUMMARY

A local dimming method comprises: segmenting an input image into N×M (N and M are positive integer greater than n) blocks; determining representative values of the blocks, which define average luminance of the respective blocks; analyzing the input image; setting a spatial filter mask having a size of n×n (n is a positive integer greater than 3 and equal to or smaller than 10), increasing the number of coefficients greater than 0 in the spatial filter mask when the input image is determined as a dark image, and decreasing the number of coefficients greater than 0 in the spatial filter mask when the input image is determined as a bright image; and multiplying the block representative values by coefficients of the spatial filter mask to determine a dimming value for each block.

In another aspect, a liquid crystal display comprises: a liquid crystal display panel; a backlight unit including a backlight emitting surface segmented into N×M (N and M are positive values greater than n) blocks and irradiating light to the liquid crystal display panel; a backlight driver controlling light sources of the backlight unit for the respective segmented blocks of the backlight emitting surface; and a local dimming circuit independently controlling a luminance of each block of the backlight emitting surfaces on the basis of an analysis result of an input image.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 5A shows a mask of a spatial filter and coefficients allocated to respective blocks of the mask;

FIG. 5B shows mask coefficients of a spatial filter, which are selected as high values, when a dark image is input as shown in FIG. 3A;

FIG. 5C shows mask coefficients of a spatial filter, which are selected as low values, when a bright image is input as shown in FIG. 3B;

DETAILED DESCRIPTION OF THE DRAWINGS AND THE PRESENTLY PREFERRED EMBODIMENTS

Reference will now be made in detail to the preferred embodiments of the present invention, examples of which are illustrated in the accompanying drawings.

Figure 2:
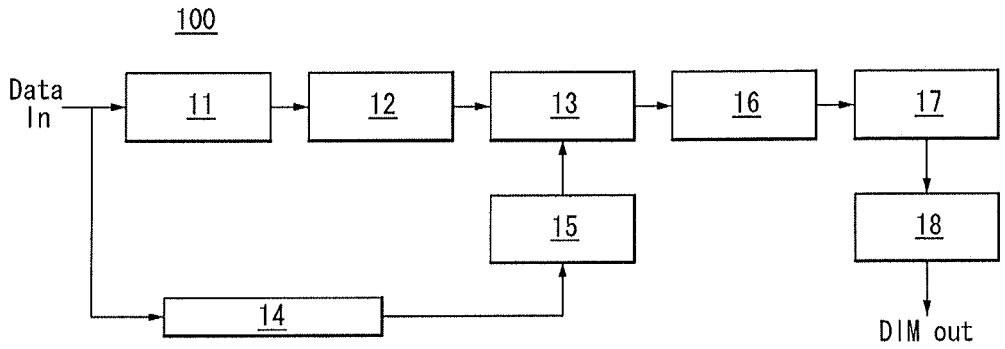
FIG. 2 is a block diagram of a local dimming circuit according to an embodiment of the invention.

Referring to FIG. 2, a local dimming circuit 100 includes a block segmentation unit 11, a block representative value determination unit 12, an image analysis unit 14, a spatial filter coefficient selector 15, a spatial filter 13, a temporal filter 16, a dimming value determination unit 17, and a light source controller 18.

The block segmentation unit 11 segments an input image into N×M (N and M are positive integer greater than n) blocks, which is larger than the number of mask segments of the spatial filter 13. A light-emitting surface of a backlight is segmented into N×M blocks corresponding to the segmented blocks of the image.

The block representative value determination unit 12 determines a representative value of each block. The representative value for each block may be calculated as an average value or an average picture level (APL) of an input image data as much as one frame image. The average value of the input image corresponds to a mean value of highest values among RGB pixel values of input image data. The APL corresponds to a mean value of luminance values Y of the input image data.

Figure 3A:
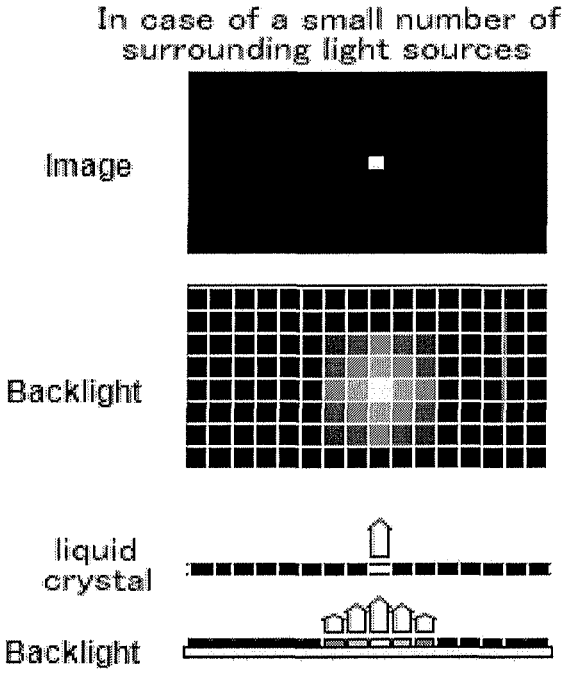
FIG. 3A shows an image displayed on a liquid crystal display panel when a dark image is input, and lit blocks in case of local dimming.
Figure 3B:
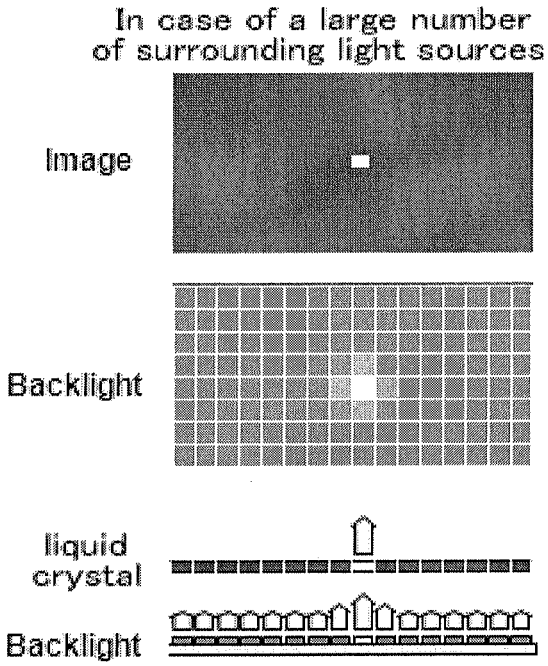
FIG. 3B shows an image displayed on a liquid crystal display panel when a bright image is input, and lit blocks in case of local dimming.
Figure 4A:
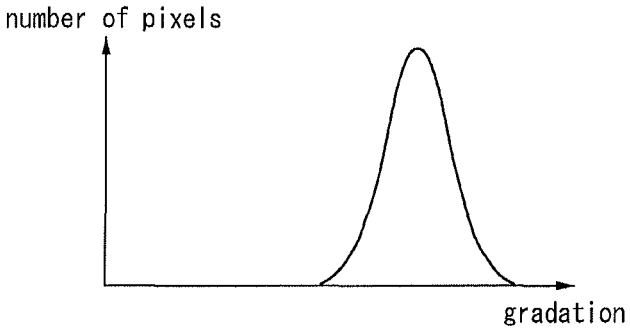
FIG. 4A is a histogram of an image as shown in FIG. 3A.
Figure 4B:
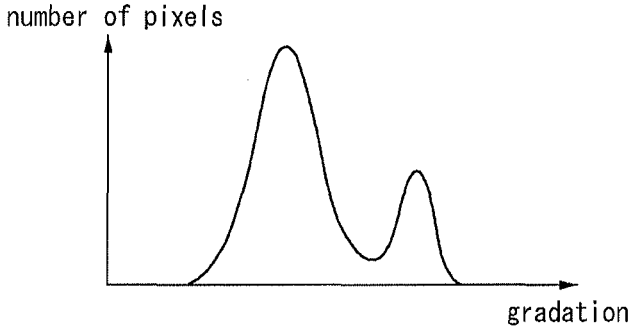
FIG. 4B is a histogram of an image as shown in FIG. 3B.

The image analysis unit 14 calculates a histogram or APL for one frame image, and provides a histogram analysis result or the APL to the spatial filter selector 15. If an image with a specific bright portion and low-luminance background is input, as shown in FIG. 3A, a histogram of the image may be calculated as shown in FIG. 4A. If an image bright overall is input as shown in FIG. 3B, a histogram of the image may be calculated as shown in FIG. 4B. In addition, when an image with a specific bright portion and low-luminance background is input, as shown in FIG. 3A, the APL of the image is calculated as a relatively low value. When an image bright overall is input as shown in FIG. 3B, the APL of the image is calculated as a high value.

The histogram of FIG. 4A, in which a number of high-gradation pixels is small and they are concentrated on a specific gradation, represents an input image that is dark overall and has a small number of bright pixel data. For the dark image as shown in FIGS. 3A and 4A, if blocks of a light-emitting surface of a backlight are considered as light sources, the number of surrounding light sources that are lit according to the spatial filter increases.

On the contrary, a histogram of an image bright overall, as shown in FIG. 3B, can be calculated as shown in FIG. 4B. The histogram of FIG. 4B, in which a number of high-gradation pixels is large and they are dispersed in a wide gradation range, represents an input image that is bright overall and has a large number of bright pixel data. For the bright image as shown in FIGS. 3B and 4B, if blocks of a light-emitting surface of a backlight are considered as light sources, the number of surrounding light sources that are lit due according to the spatial filter decreases.

The spatial filter coefficient selector 15 selects coefficients of a spatial filter mask having a size of n×n (n is a positive integer greater than 3 and equal to or smaller than 10). Although the mask size of the spatial filter is 5×5 in the following description, the mask size is not limited thereto. The spatial filter coefficient selector 15 receives the histogram analysis result or APL from the image analysis unit 14 and selects mask coefficients of the spatial filter, which are varied with the histogram analysis result or APL.

The spatial filter coefficient selector 15 compares histograms of a previous frame image and a current frame image with each other. If the number of bright pixels in the current frame image histogram decreases, the spatial filter coefficient selector 15 increases the size of spatial filter mask blocks having coefficients greater than 0, as shown in FIG. 5B, so as to increase the number of lit light sources of local dimming blocks (or backlight light-emitting surface blocks). On the contrary, if the number of bright pixels in the current frame image histogram increases, the spatial filter coefficient selector 15 reduces the size of spatial filter mask blocks having coefficients greater than 0, as shown in FIG. 5C, so as to decrease the number of lit light sources of local dimming blocks.

In another embodiment, the spatial filter coefficient selector 15 compares a predetermined reference APL with an APL of a current frame image. If the APL of the current frame image is lower than the reference APL, the spatial filter coefficient selector 15 increases the size of spatial filter mask blocks having coefficients greater than 0, as shown in FIG. 5C, so as to increase the number of lit light sources of local dimming blocks. On the contrary, if the APL of the current frame image is higher than the reference APL, the spatial filter coefficient selector 15 reduces the size of spatial filter mask blocks having coefficients greater than 0, as shown in FIG. 5C, so as to decrease the number of lit light sources of local dimming blocks.

The spatial filter mask may be set as a 5×5 mask as shown in FIG. 5A, and coefficients h1 to h25 may be allocated to respective blocks of the mask. The spatial filter coefficient selector 15 increases the number of local dimming lit blocks by increasing the size of mask blocks having coefficients greater than 0 when a dark image, as shown in FIG. 3A, is input. In addition, the spatial filter coefficient selector 15 reduces the size of mask blocks having coefficients greater than 0 by substituting coefficients allocated to the edge of the mask with 0 so as to decrease the number of local dimming lit blocks when a bright image, as shown in FIG. 3B, is input.

The spatial filter coefficient selector 15 compares histograms of a previous frame image and a current frame image with each other and, if the number of bright pixels in the current frame image histogram decreases, increases the spatial filter mask coefficients, as shown in FIG. 5B, in order to increase the luminance of lit blocks. On the other hand, the spatial filter coefficient selector 15 compares the histograms of the previous frame image and the current frame image with each other and, if the number of bright pixels in the current frame image histogram increases, decreases the spatial filter mask coefficients, as shown in FIG. 5C, in order to reduce the luminance of lit blocks.

In another embodiment, the spatial filter coefficient selector 15 compares a predetermined reference APL with an APL of a current frame image and, if the APL of the current frame image is lower than the reference APL, selects the spatial filter mask coefficients as high values, as shown in FIG. 5B, in order to increase the luminance of lit blocks. On the other hand, the spatial filter coefficient selector 15 compares the predetermined reference APL with the APL of the current frame image and, if the APL of the current frame image is higher than the reference APL, selects the spatial filter mask coefficients as low values, as shown in FIG. 5C, in order to reduce the luminance of lit blocks.

As described above, the spatial filter coefficient selector 15 selects the spatial filter mask coefficients as high values to increase the luminance of lit blocks when a dark image, as shown in FIG. 3A, is input and selects the spatial filter mask coefficients as relatively low values to reduce the luminance of lit blocks when a bright image, as shown in FIG. 3B, is input.

The spatial filter 13 multiplies the representative values x1 to x25 for respective blocks, input from the block representative value determination unit 12, by the mask coefficients selected by the spatial filter coefficient selector 15 and provides a dimming value for each block, which is generated from the multiplication, to the temporal filter 16.

Figure 6:
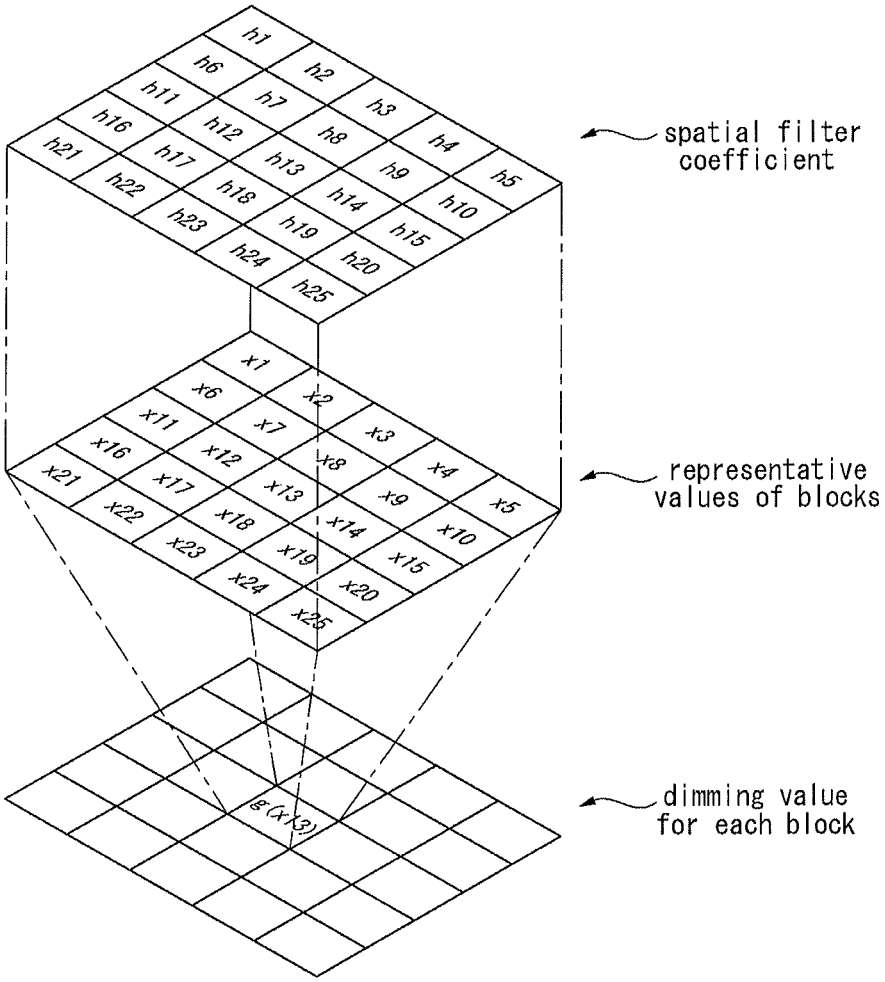
FIG. 6 illustrates an operation of a spatial filter.

An output g(x13) of the spatial filter 13 may be represented by Equation (1) and schematized as illustrated in FIG. 6.

$$g(x13)=x1\cdot h1+x2\cdot h2+\ldots+x24\cdot h24+x25\cdot h25 \quad (1)$$

The temporal filter 16 disperses the dimming value for each block, received from the spatial filter 13, for a plurality of frame periods to prevent flicker. The temporal filter 16 may temporally disperse the dimming value for each block using an infinite impulse response (IIR) filter or a finite impulse response (FIR) filter. For example, the temporal filter 16 may use the filter described in Korean Patent Application No. 10-2008-0007282 (23 Jan. 2008) applied by the Applicant and may be implemented by any known temporal filter.

The dimming value determination unit 17 codes the dimming value for each block, received from the temporal filter 16, into data in serial peripheral interface (SPI) format and provides the data to a micro control unit (MCU) of the light source controller 18.

The light source controller 18 independently controls light sources of a backlight 300 for respective blocks according to pulse width modulation (PWM) that Varies a duty ratio with the dimming value DIMim received from the dimming value determination unit 17. A PWM signal is input to a light source driver to control an ON-OFF ratio of the light sources, and its duty ratio (%) is determined depending on the dimming value for each block, input to the light source controller 18. The duty ratio of the PWM signal increases as the dimming value for each block increases whereas the duty ratio of the PWM signal decreases as the dimming value for each block decreases.

Figure 7:
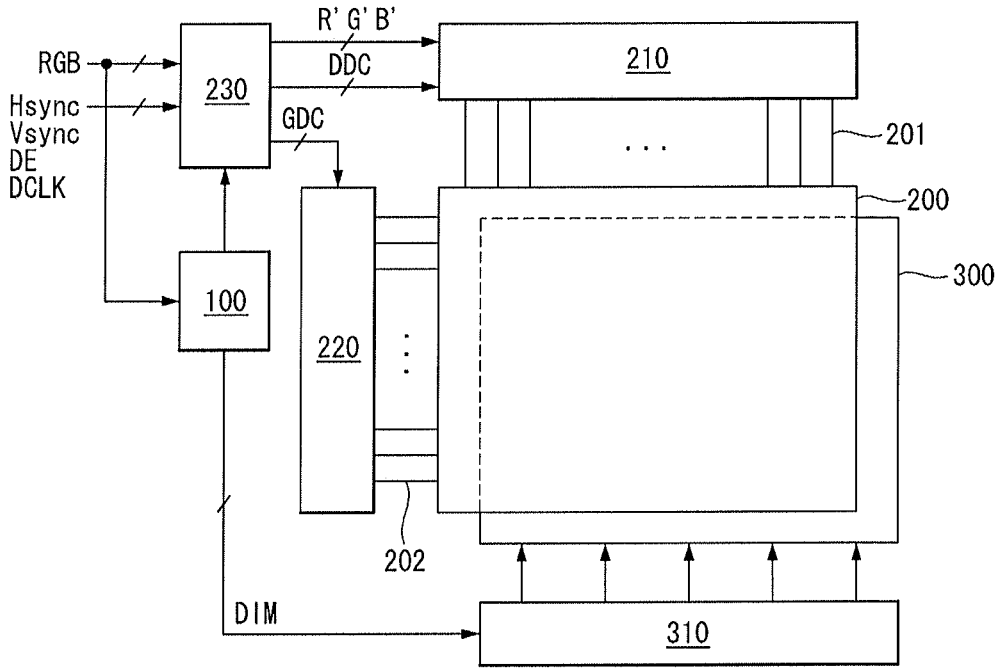
FIG. 7 is a block diagram of a liquid crystal display according to an embodiment of the invention.

FIG. 7 is a block diagram of a liquid crystal display according to an embodiment of the present invention.

Referring to FIG. 7, the liquid crystal display includes a liquid crystal display panel 200, a source driver 210 for driving data lines 201 of the liquid crystal display panel 200, a gate driver 220 for driving gate lines 202 of the liquid crystal display panel 200, a timing controller 230 for controlling the source driver 210 and the gate driver 220, a backlight unit 300 for irradiating light to the liquid crystal display panel 200, a light source driver 310 for driving light sources of the backlight unit 300, and a local dimming circuit 100 for controlling local dimming.

The liquid crystal display panel 200 includes a liquid crystal layer interposed between two glass substrates. In the liquid crystal display panel 200, liquid crystal cells are arranged in a matrix form according to an intersection structure of the data lines 201 and the gate lines 202. A thin film transistor (TFT) array substrate of the liquid crystal display panel 200 includes the data lines 201, gate lines 202, TFTs, pixel electrodes of liquid crystal cells connected to the TFTs and storage capacitors, which are formed thereon.

A color filter substrate of the liquid crystal display panel 200 includes a black matrix, a color filter and a common electrode, which are formed thereon.

The liquid crystal display of the invention may be implemented in a vertical field driving mode such as a twisted nematic (TN) mode and vertical alignment mode and a horizontal field driving mode such as an in-plane switching mode and fringe field switching mode.

A pixel array of the liquid crystal display 200 and a light-emitting surface of the backlight unit 300, which is opposite to the pixel array, are virtually segmented into N×N blocks for local dimming. Each of the blocks includes i×j (i and j are positive integer equal to or greater than 2) pixels and the backlight emitting surface that irradiates light to the pixels. Each of the pixels includes sub-pixels of three primary colors or more, and each sub-pixel includes a liquid crystal cell.

The timing controller 230 receives timing signals Vsync, Hsync, DE and DCLK from an external host system and supplies digital video data RGB to the source driver 210. The timing signals includes a vertical synchronization signal Vsync, a horizontal synchronization signal Hsync, a data enable signal DE, a dot clock signal DCLK, etc. The timing controller 230 generates timing control signals DDC and GDC for controlling operation timings of the source driver 210 and the gate driver 220 on the basis of the timing signals Vsync, Hsync, DE and DCLK from the host system. The timing controller 230 may supply the digital video data RGB of an input image received from the host system to the local dimming circuit 100 and provide digital video data R'G'B' modulated by the local dimming circuit 100 to the source driver 210.

The source driver 210 latches the digital video data R'G'B' under the control of the timing controller 230. In addition, the source driver 210 converts the digital video data R'G'B' into a positive/negative analog data voltage using a positive/negative gamma compensation voltage and provides the positive/negative analog data voltage to the data lines 201. The gate driver 220 sequentially supplies gate pulses (or scan pulses) synchronized with the data voltage on the data lines 201 to the gate lines 202.

The backlight unit 300 is arranged under the liquid crystal display panel 200. The backlight unit 300 includes a plurality of light sources independently controlled for respective blocks by the light source driver 310 and uniformly irradiates light to the liquid crystal display panel 200. The backlight unit 300 may be implemented as a direct type backlight unit or an edge type backlight unit. The light sources of the backlight unit 300 may be implemented as dot light sources such as a light emitting diode (LED).

The light source driver 310 independently drives the light sources of the backlight unit 300 for respective blocks through PWM that varies a duty ratio with a dimming value DIM for each block, received from the local dimming circuit 100, to control luminances of backlight lit blocks under the control of the local dimming circuit 100.

Figure 1A:
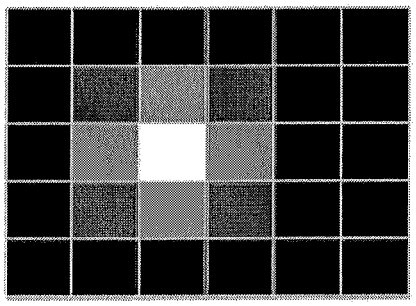
FIG. 1A (RELATED ART)
FIGS. 1A, 1B and 1C illustrate luminances by block sizes in a case where a peak luminance of one block is diffused to 3×3 blocks through a spatial filter having a 3×3 mask.
Figure 1B:
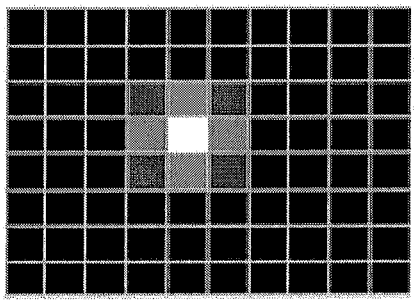
FIG. 1B (RELATED ART)
Figure 1C:
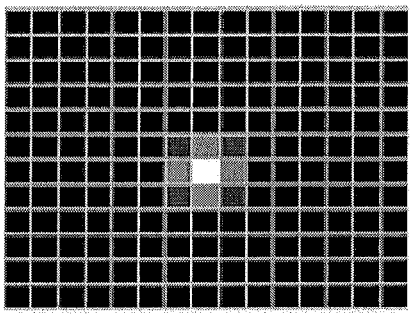
FIG. 1C (RELATED ART)

The local dimming circuit 100 is implemented as shown in FIG. 1, selects spatial filter mask coefficients depending on an input image analysis result and adjusts representative values of respective blocks. The local dimming circuit 100 may compensate for low backlight luminance using a look-up table (not shown), modulate the digital video data RGB input from the timing controller 230 in order to prevent data gradations from saturation, and provide the modulated data R'G'B' to the timing controller 230.

As described above, the present invention increases the size of a spatial filter mask assigned coefficients when a dark image corresponding to a small number of surrounding light sources of the backlight unit is input and decreases the size of the spatial filter mask when a bright image corresponding to a large number of surrounding light sources of the backlight unit is input. Consequently, the present invention can prevent luminance deterioration occurring when the number of segmented blocks increases in the event of local dimming.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A local dimming method comprising:

segmenting an input image into N×M (N and M are positive integer greater than n) blocks;

determining representative values of the blocks, which define average luminance of the respective blocks;

analyzing the input image;

setting a spatial filter mask having a size of n×n (n is a positive integer greater than 3 and equal to or smaller than 10), the spatial filter mask having variable coefficients;

changing the variable coefficients of the spatial filter to increase the number and value of coefficients greater than 0 in the spatial filter mask when the input image is determined as a darker image than a previous frame image or a reference image, and to decrease the number and value of coefficients greater than 0 in the spatial filter mask when the input image is determined as a brighter image than the previous frame image or the reference image, the value of coefficients greater than 0 for the brighter image forming a size of k×k and being completely surrounded by value of coefficients equal to 0, wherein k is smaller than n; and multiplying the block representative values by the variable coefficients of the spatial filter mask that have been changed to determine a dimming value for each block, wherein the value of each of the coefficients for the darker image is larger than the value of each of the coefficients for the brighter image in corresponding positions.

2. The local dimming method of claim 1, further comprising selecting the coefficients of the spatial filter mask as high values when the input image is determined as a dark image, and selecting the coefficients of the spatial filter mask as low values when the input image is determined as a bright image.

3. The local dimming method of claim 1, wherein the analyzing of the input image comprises:

calculating one of a histogram and an average picture level of the input image; and determining a degree of brightness of the input image on the basis of one of the histogram and the average picture level.

4. The local dimming method of claim 1, further comprising dispersing the dimming value for each block for a plurality of frame periods using a temporal filter.

5. The local dimming method of claim 1, further comprising:

virtually segmenting a backlight emitting surface into N×M blocks; and independently controlling a luminance of each block of the backlight emitting surface on the basis of the dimming value for each block.

6. A liquid crystal display comprising:

a liquid crystal display panel;

a backlight unit including a backlight emitting surface segmented into N×M (N and M are positive values greater than n) blocks and irradiating light to the liquid crystal display panel;

a backlight driver controlling light sources of the backlight unit for the respective segmented blocks of the backlight emitting surface; and a local dimming circuit independently controlling a luminance of each block of the backlight emitting surfaces on the basis of an analysis result of an input image, wherein the local dimming circuit comprises:

a block segmentation unit segmenting the input image into N×M (N and M are positive integer greater than n) blocks;

a block representative value determination unit determining representative values of the blocks, which define average luminance of the respective blocks;

a spatial filter having variable coefficients and multiplying the block representative values by the variable mask coefficients that have been changed based on a comparison between the input image for a current frame and an image displayed in a previous frame to output a dimming value for each block;

an image analysis unit analyzing the input image; and a spatial filter coefficient selector setting a spatial filter mask having a size of n×n (n is a positive integer greater than 3 and equal to or smaller than 10), changing the variable coefficients of the spatial filter to increase the number and value of coefficients greater than 0 in the spatial filter mask when the input image is determined as a darker image than a previous frame image or a reference image, and to decrease the number and value of coefficients greater than 0 in the spatial filter mask when the input image is determined as a brighter image than the previous frame image or the reference image the value of coefficients greater than 0 for the brighter image forming a size of k×k and being completely surrounded by value of coefficients equal to 0, wherein k is smaller than n, wherein the value of each of coefficients for the darker image is larger than the value of each of the coefficients for the brighter image in corresponding positions.

7. The liquid crystal display of claim 6, wherein the spatial filter coefficient selector selects coefficients of the spatial filter mask as high values when the input image is determined as a dark image, and selects the coefficients of the spatial filter mask as low values when the input image is determined as a bright image.

8. The liquid crystal display of claim 6, wherein the image analysis unit calculates one of a histogram and an average picture level of the input image, and determines a degree of brightness of the input image on the basis of one of the histogram and the average picture level.

9. The liquid crystal display of claim 6, further comprising a temporal filter dispersing the dimming value for each block, input from the spatial filter, for a plurality of frame periods.

10. The liquid crystal display of claim 6, wherein the local dimming circuit further comprises a backlight controller controlling the backlight driver on the basis of the dimming value for each block so as to adjust a luminance of each block of the backlight emitting surface.

* * * * *